US010472829B1

(12) United States Patent
Froehlich

(10) Patent No.: US 10,472,829 B1
(45) Date of Patent: Nov. 12, 2019

(54) ROOF GUTTER CAP SYSTEM

(71) Applicant: Fred Froehlich, Canton, MI (US)

(72) Inventor: Fred Froehlich, Canton, MI (US)

( * ) Notice: Subject to any disclaimer, the term of this patent is extended or adjusted under 35 U.S.C. 154(b) by 0 days.

(21) Appl. No.: 16/156,148

(22) Filed: Oct. 10, 2018

Related U.S. Application Data

(60) Provisional application No. 62/701,017, filed on Jul. 20, 2018.

(51) Int. Cl.
*E04D 13/076* (2006.01)

(52) U.S. Cl.
CPC ..... *E04D 13/076* (2013.01)

(58) Field of Classification Search
CPC ..... E04D 13/076
USPC ..... 52/12; 210/162
See application file for complete search history.

(56) References Cited

U.S. PATENT DOCUMENTS 546,042 A * 9/1895 Van Horn ..... E04D 13/076 52/12
2,674,961 A * 4/1954 Lake ..... E04D 13/076 210/474
2,847,949 A * 8/1958 Pond ..... E04D 13/076 248/48.1
3,080,682 A * 3/1963 Teutsch ..... E04D 13/076 248/48.2
3,388,555 A * 6/1968 Foster ..... E04D 13/076 405/119
3,864,267 A * 2/1975 Nelems ..... B01D 35/00 210/474
4,590,716 A * 5/1986 Smith ..... E04D 13/076 52/11
4,592,174 A * 6/1986 Hileman ..... E04D 13/076 210/474
4,937,986 A * 7/1990 Way, Sr. ..... E04D 13/076 210/474
5,010,696 A * 4/1991 Knittel ..... E04D 13/076 210/474
5,099,620 A * 3/1992 Carey ..... E04D 13/076 52/12
5,189,849 A * 3/1993 Collins ..... E04D 13/076 52/11
5,813,173 A * 9/1998 Way, Sr. ..... E04D 13/076 210/474
D722,682 S * 2/2015 Fox ..... D23/267
(Continued)

FOREIGN PATENT DOCUMENTS

CA 2312925 A1 * 6/1999 ..... E04D 13/076
DE 9412622 U1 * 9/1994
DE 4439958 A1 * 5/1996 ..... E04D 13/076

*Primary Examiner* — Robert Canfield
(74) *Attorney, Agent, or Firm* — Mitchell Law PLLC; Matthew W. Mitchell

(57) ABSTRACT

A roof gutter cap system includes a water channeling panel configured to contact an angled roof surface. The water channeling panel includes a plurality of apertures configured to channel water from the roof surface into a gutter attached to the roof. The system further includes a gutter shield panel configured to span a distance between the gutter and the water channeling panel and prevent debris from entering the gutter. In one embodiment, the water channeling panel includes a flat base and a plurality of appendages protruding upwardly from the flat base. In another embodiment, the water channeling panel includes a corrugated section including a repeating alternating wall pattern.

5 Claims, 9 Drawing Sheets

(56) References Cited

U.S. PATENT DOCUMENTS

| | | | | |
|---|---|---|---|---|
| 9,394,694 | B2 * | 7/2016 | Iannelli | E04D 13/064 |
| 2012/0060428 | A1 * | 3/2012 | Lowrie, III | E04D 13/076<br>52/12 |
| 2018/0127981 | A1 * | 5/2018 | Brochu | E04D 13/076 |

* cited by examiner

ROOF GUTTER CAP SYSTEM

CROSS-REFERENCE TO RELATED APPLICATIONS

This disclosure claims the benefit of U.S. Provisional Patent Application No. 62/701,017 filed on Jul. 20, 2018, which is hereby incorporated by reference.

TECHNICAL FIELD

This disclosure is related to a system configured to guide water into a roof gutter, in particular, to a system configured to guide water into a roof gutter while keeping leaving and pine needles out of the gutter.

BACKGROUND

The statements in this section merely provide background information related to the present disclosure. Accordingly, such statements are not intended to constitute an admission of prior art.

Gutters are installed around roofs of homes and structures to catch water falling off of the roof shingles or tiles and channel the water into a downspout. Effective gutters are important, helping to manage water around a structure, avoiding water damage and water runoff in damaging areas. Gutters can become clogged with leaves, pine needles, and other debris that collects on roofs.

Known gutter protection systems sit on top of the gutter and seem to rely upon shuttering the top of the gutter. Small slots or grates on top of the gutter protection systems are supposed to allow water into the gutter without permitting debris into the gutter. They typically keep some of the leaves and debris out of the gutter. Most fail at directing much of the water into the gutter, especially during hard rains.

SUMMARY

A roof gutter cap system includes a water channeling panel configured to contact an angled roof surface. The water channeling panel includes a plurality of apertures configured to channel water from the roof surface into a gutter attached to the roof. The system further includes a gutter shield panel configured to span a distance between the gutter and the water channeling panel and prevent debris from entering the gutter. In one embodiment, the water channeling panel includes a flat base and a plurality of appendages protruding upwardly from the flat base. In another embodiment, the water channeling panel includes a corrugated section including a repeating alternating wall pattern.

BRIEF DESCRIPTION OF THE DRAWINGS

One or more embodiments will now be described, by way of example, with reference to the accompanying drawings, in which.

DETAILED DESCRIPTION

An improved gutter protection system is provided which includes a gate keeping structure providing apertures at an edge of a roof panel, such that water can flow into the apertures. The apertures filter away most debris and prevent the debris from entering the gutter below the gutter protection system.

Figure 1:
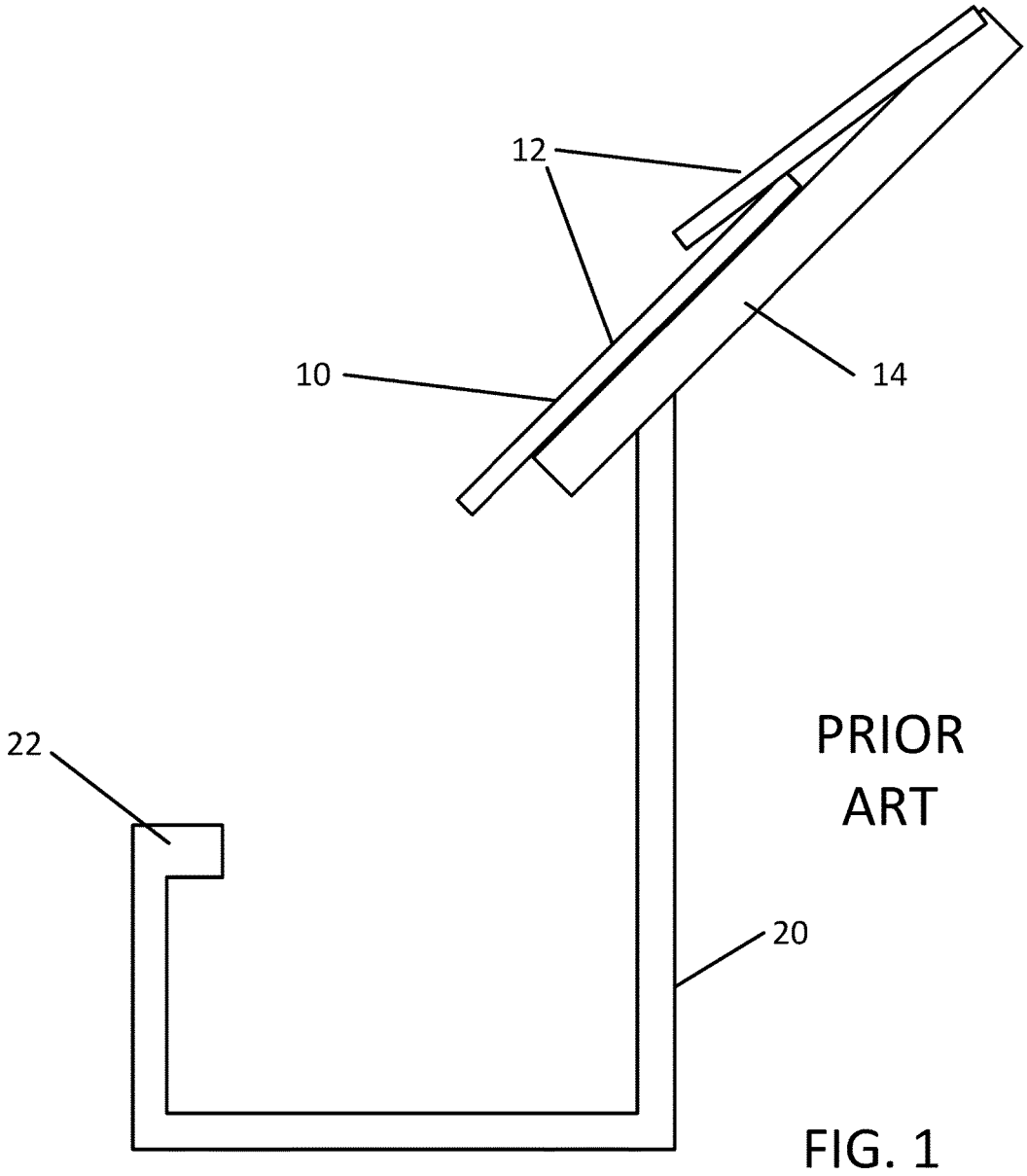
FIG. 1 illustrates in side sectional view a known roof configuration, in accordance with the present disclosure.

Referring now to the drawings, wherein the showings are for the purpose of illustrating certain exemplary embodiments only and not for the purpose of limiting the same, FIG. 1 illustrates a known roof configuration. Roof 10 is illustrated including exemplary asphalt shingles 12 and subroof panel 14, along with attached gutter 20 and gutter rim 22. These are typical roof components provided for clarity in comparison the other figures.

Figure 2:
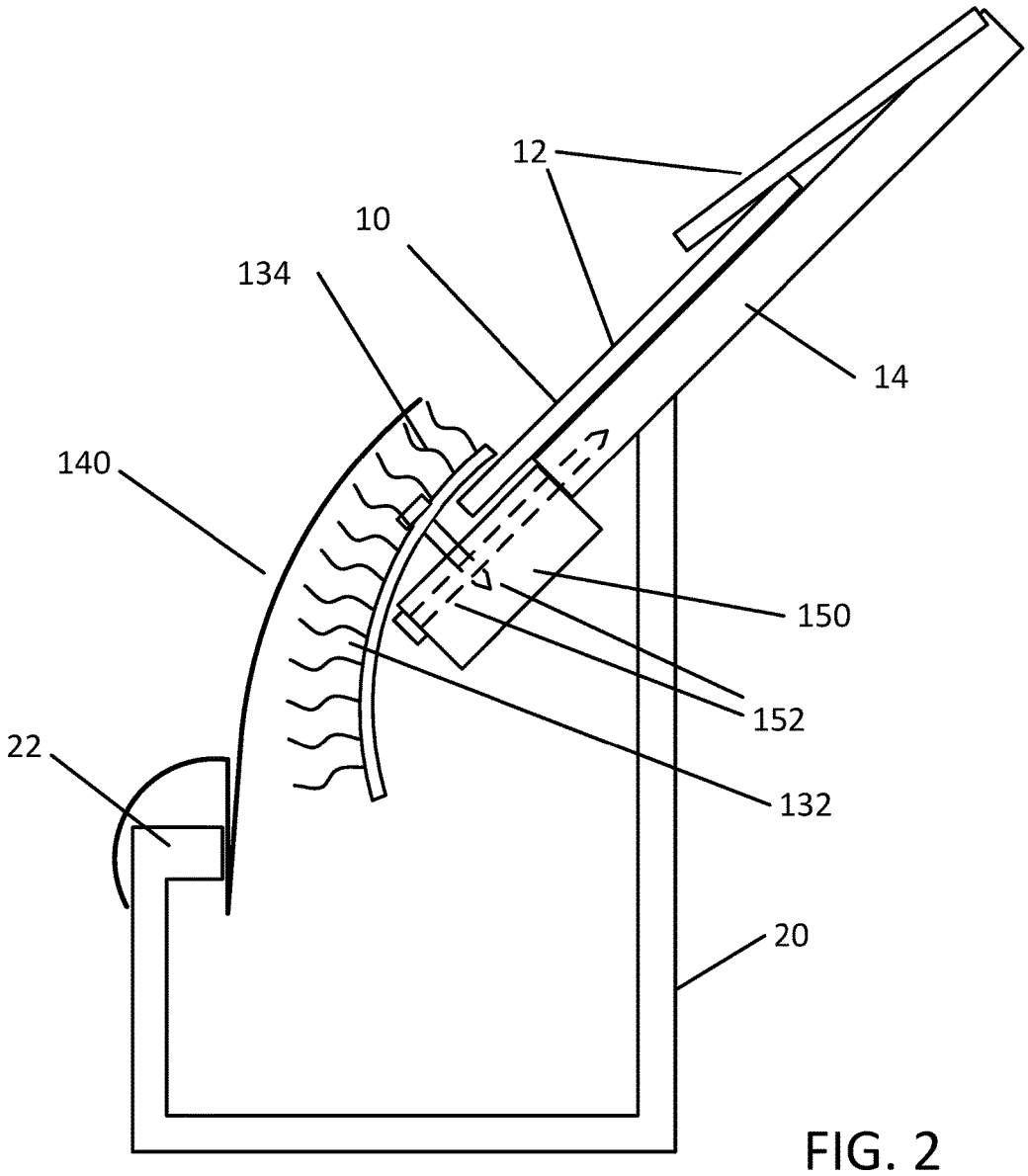
FIG. 2 illustrates in side sectional view an exemplary gutter protection system for guiding water into a gutter while keeping debris out, in accordance with the present disclosure.

FIG. 2 illustrates in side sectional view an exemplary gutter protection system for guiding water into a gutter while keeping debris out. Roof 10 is illustrated including exemplary asphalt shingles 12 and subroof panel 14, along with attached gutter 20 and gutter rim 22. A piece of exemplary plastic grass material is provided as water channeling panel 132. Panel 132 is attached to a plastic block 150 which is attached to subroof panel 14 with fasteners 152. Fasteners 152 are exemplary, and block 150 can be attached in any known way to subroof panel 14. Block 150 can be made out of plastic, wood, or any other material that can be exposed to weather in a roofing environment without significantly degrading. Gutter shield panel 140 protects panel 132 and stops debris from entering gutter 20. The plastic grass leaves 134 of panel 132 provide interstitial space for water to travel through, but the leaves 134 and the spaces between can be spaced irregularly, so only water or very small objects could get through grass leaves 134. The grass leaves 134 act as a gate keeping structure.

Gutter shield panel 140 is illustrated as an exemplary bent piece of metal such as aluminum and is constructed to clamp onto gutter rim 22. In other embodiments, gutter shield panel 140 could be connected to water channeling panel 132 with or without being connected to gutter 20. The illustration of gutter rim 22 is exemplary, can include many different shapes, and panel 140 can include matching champing features depending upon the particular shape of an existing gutter. Gutter shield panel 140 covers most or all ends of the plastic grass leaves such that the leaves are protected from damage and to prevent debris from bypassing the leaves and getting into the gutter.

Plastic grass material is known in the art and includes a panel base frequently constructed with a polymerized material. The plastic grass leaves are typical polymerized strips that are attach to the panel base and extend upwardly from the base, terminating at a grass leave free end. Other similar materials not intended to imitate grass can be substituted for plastic grass, including but not limited to a panel base with bristles pointing upwardly from the base, similar to a hair brush. In one embodiment, plastic grass, bristles, or other similar structures can be described as appendages protruding upwardly from a flat base, wherein the appendages can be described as gate keeping structures and with space between the appendages being described as a plurality of apertures configured to channel water between the appendages.

Roof 10 is illustrated to include exemplary asphalt shingles. It will be appreciated that the system can be used in combination with slanted metal roofs, slanted tile roofs, and any other similar roof surface which channels water into a gutter.

Figure 3:
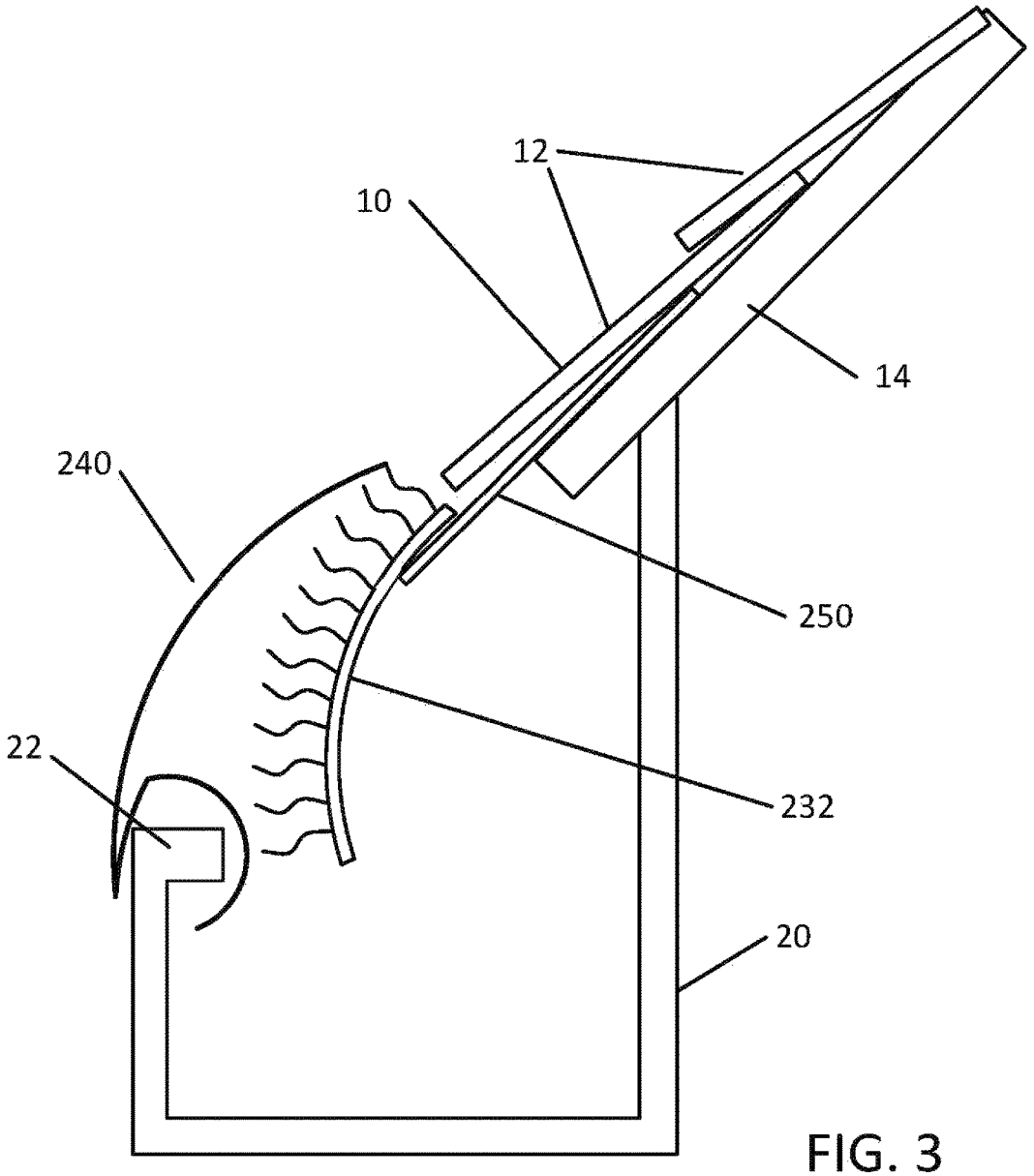
FIG. 3 illustrates in side sectional view a second exemplary gutter protection system for guiding water into a gutter while keeping debris out, in accordance with the present disclosure.

FIG. 3 illustrates in side sectional view a second exemplary gutter protection system for guiding water into a gutter while keeping debris out. Roof 10 is illustrated including exemplary asphalt shingles 12 and subroof panel 14, along with attached gutter 20 and gutter rim 22. A piece of exemplary plastic grass material is provided as a water channeling panel 232. Panel 232 is attached to an exemplary piece of sheet metal 250 which is slid under a lowest shingle 12. Gutter shield panel 240 protects panel 232 and stops debris from entering gutter 20. The plastic grass leaves provide interstitial space for water to travel through, but the leaves and the spaces between are spaced irregularly, so only water or very small objects could get through the grass leaves. The grass leaves act as a gate keeping structure.

Figure 4:
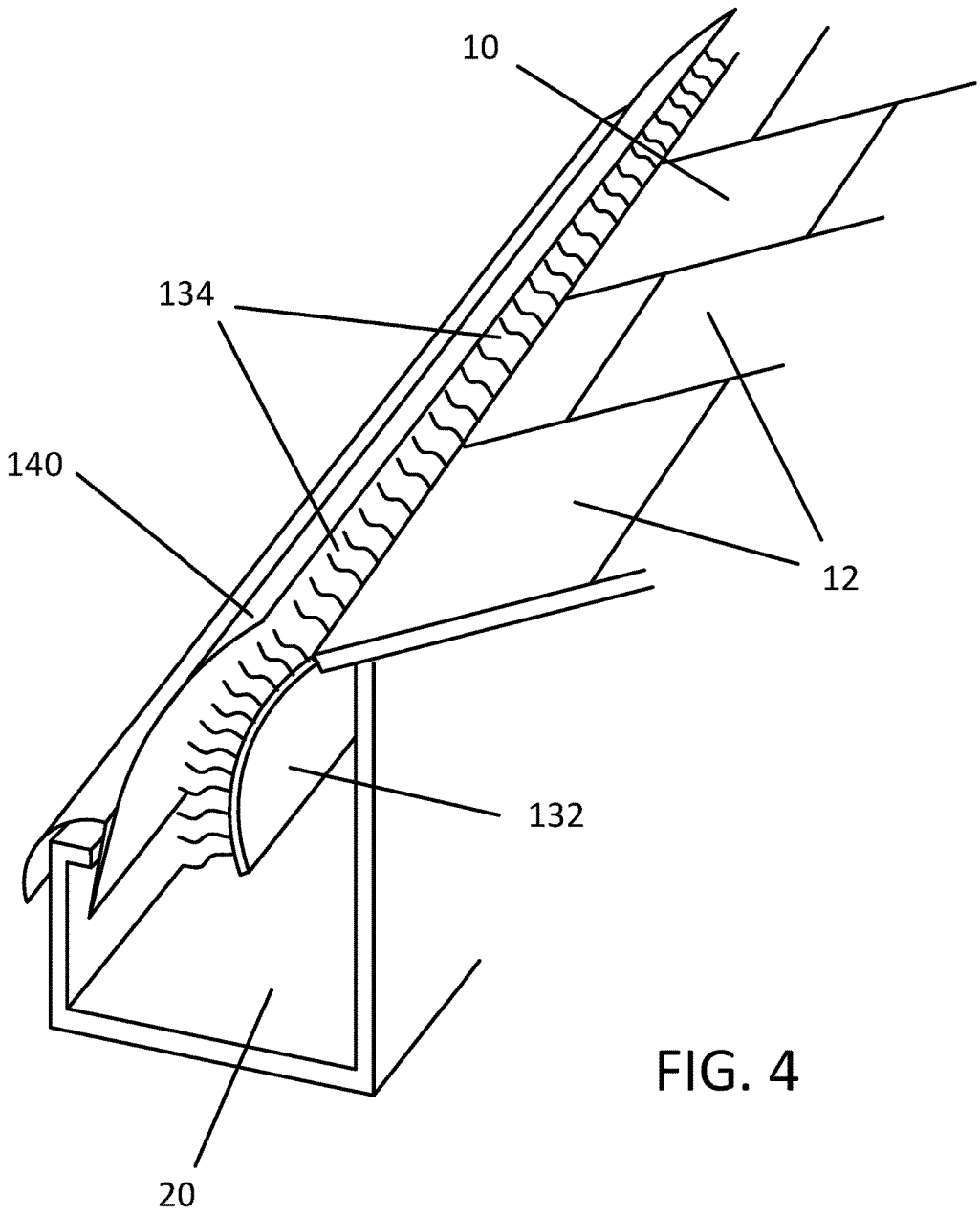
FIG. 4 illustrates in perspective view the gutter protection system of FIG. 2, in accordance with the present disclosure.

FIG. 4 illustrates in perspective view the gutter protection system of FIG. 2. It will be appreciated that the gutter protection system of FIG. 3 would appear substantially similar in a similar perspective view. Plastic grass leaves 134 of water channeling panel 132 are situated at a base of roof 10 including shingles 12. As water runs down shingles 12, it comes into contact with grass leaves 134 and can flow around the leaves into the space between the leaves. Debris running down with the water also comes into contact with grass leaves 134, but is filtered away and can fall past gutter shield panel 140 instead of going with water into gutter 20.

Figure 5:
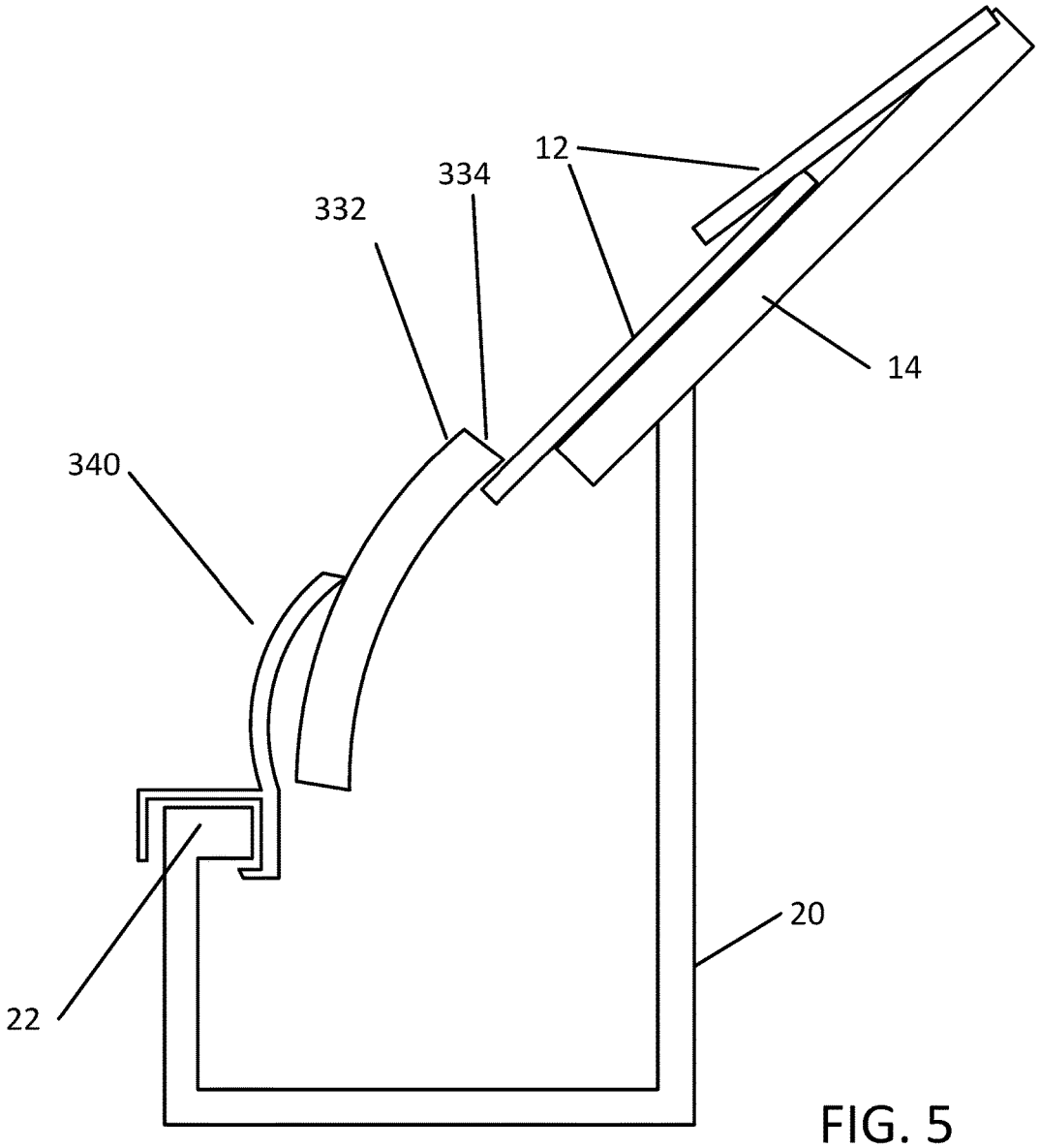
FIG. 5 illustrates in side sectional view a third exemplary gutter protection system for guiding water into a gutter while keeping debris out, in accordance with the present disclosure.
Figure 8:
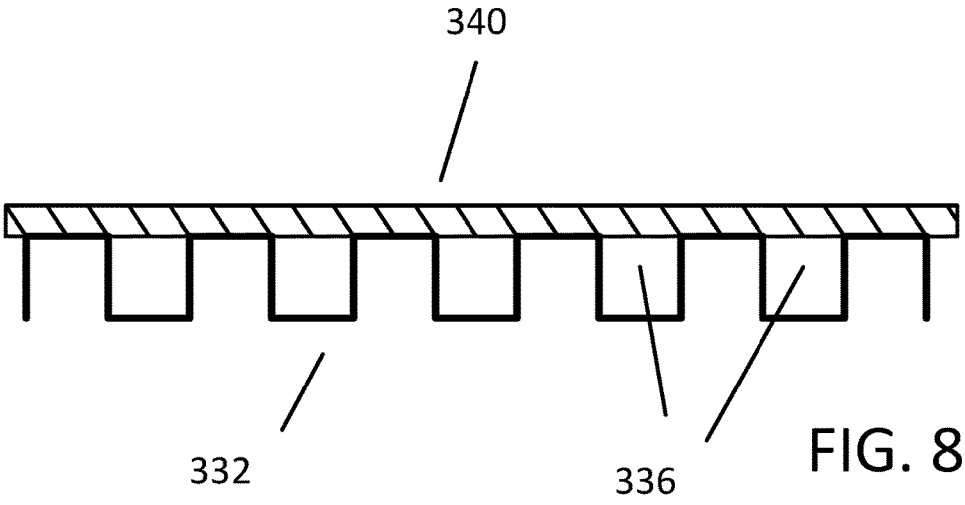
FIG. 8 illustrates in sectional view the corrugation pattern of FIG. 5 at an intersection with the gutter shield panel, in accordance with the present disclosure.

FIG. 5 illustrates in side sectional view a third exemplary gutter protection system for guiding water into a gutter while keeping debris out. Roof 10 is illustrated including exemplary asphalt shingles 12 and subroof panel 14, along with attached gutter 20 and gutter rim 22. Corrugated section 332 is provided as an exemplary plastic part and a water channeling panel. Section 332 is attached to a gutter shield panel 340. Gutter shield panel 340 can be a plastic part or an extruded metal part configured to clip onto gutter rim 22. Mechanical connection of panel 340 and the attachment of corrugation section 332 to panel 340 means that the exemplary embodiment of FIG. 5 does not need to be attached to subroof panel 14. Water can flow through the corrugated channels, while larger objects cannot. Corrugation openings 334 act as a gate keeping structure. Gutter shield panel 340 can extend up to and be proximate to corrugation openings 334. In the exemplary embodiment of FIG. 5, gutter shield panel 340 stops short of an upper end of corrugated section 332. Such an embodiment can be helpful, in that any debris collecting near corrugation openings 334 and blocking the openings does not block additional openings formed by panel 340 sitting next to the corrugation as is illustrated in FIG. 8.

Corrugation section 332 is illustrated in a curved shape. However, it can be a straight section and can be of varying lengths and thicknesses. The size of the corrugations can vary depending upon what debris is likely to be experienced for local roofs.

Corrugation section 332 includes a plurality of walls arranged in a corrugation pattern or a repeating alternating wall pattern. This corrugation pattern, oscillating back and forth, creates space between the alternating walls which can be used to channel water.

Figure 6:
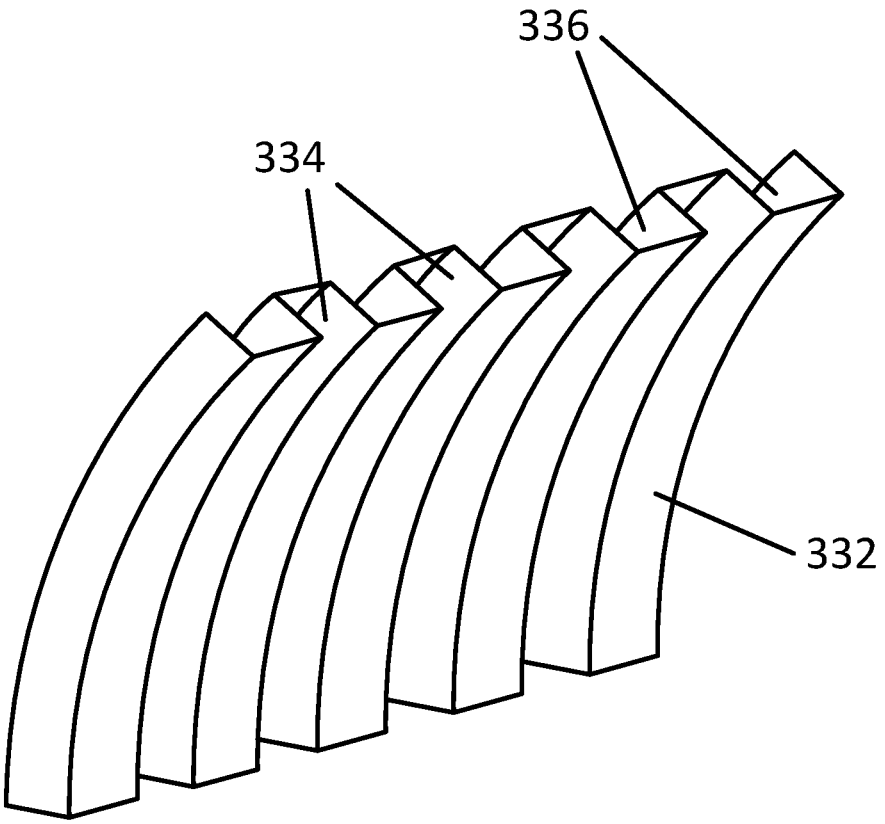
FIG. 6 illustrates in perspective view the corrugation pattern of FIG. 5, in accordance with the present disclosure.

FIG. 6 illustrates in perspective view the corrugated section of FIG. 5. Corrugated section 332 includes a plastic, metal, or similar construction including an alternating wave pattern. The wave pattern creates openings 334 below the corrugation and openings 336 above the corrugation. By placing a flat structure above and below corrugated section 332, openings 334 and 336 can be converted into water channeling apertures.

Figure 7:
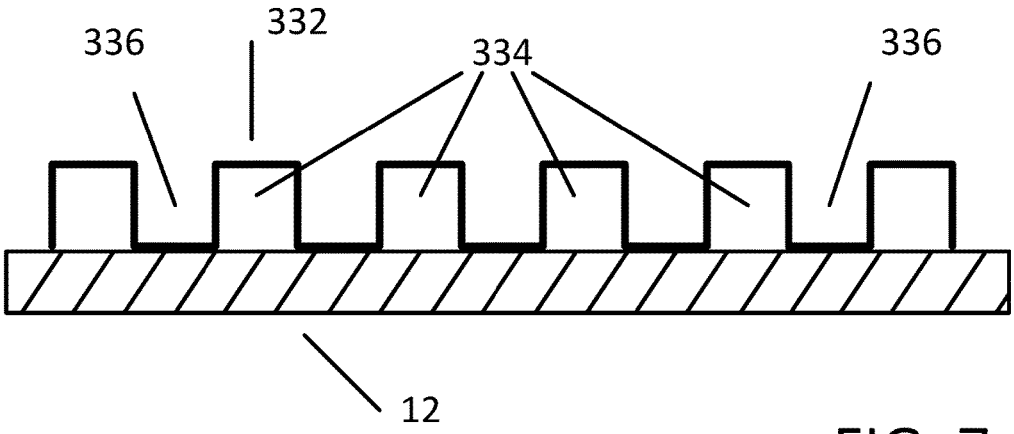
FIG. 7 illustrates in end sectional view the corrugation pattern of FIG. 5 at an intersection with a roof shingle, in accordance with the present disclosure.

FIG. 7 illustrates in end sectional view the corrugation pattern of FIG. 5 at an intersection with a roof shingle. Corrugated section 332 rests upon shingle 12. Openings 334 permit water to flow into section 332 while keeping debris out.

FIG. 8 illustrates in sectional view the corrugation pattern of FIG. 5 at an intersection with the gutter shield panel. Gutter shield panel 340 rests upon corrugated section 332. Openings 336 permit water to flow into section 332 while keeping debris out.

Openings 334 and 336, situated at an end of a slanted roof surface, provide water channeling apertures that filter out debris and permit the water to travel through the apertures into a gutter below.

Figure 9:
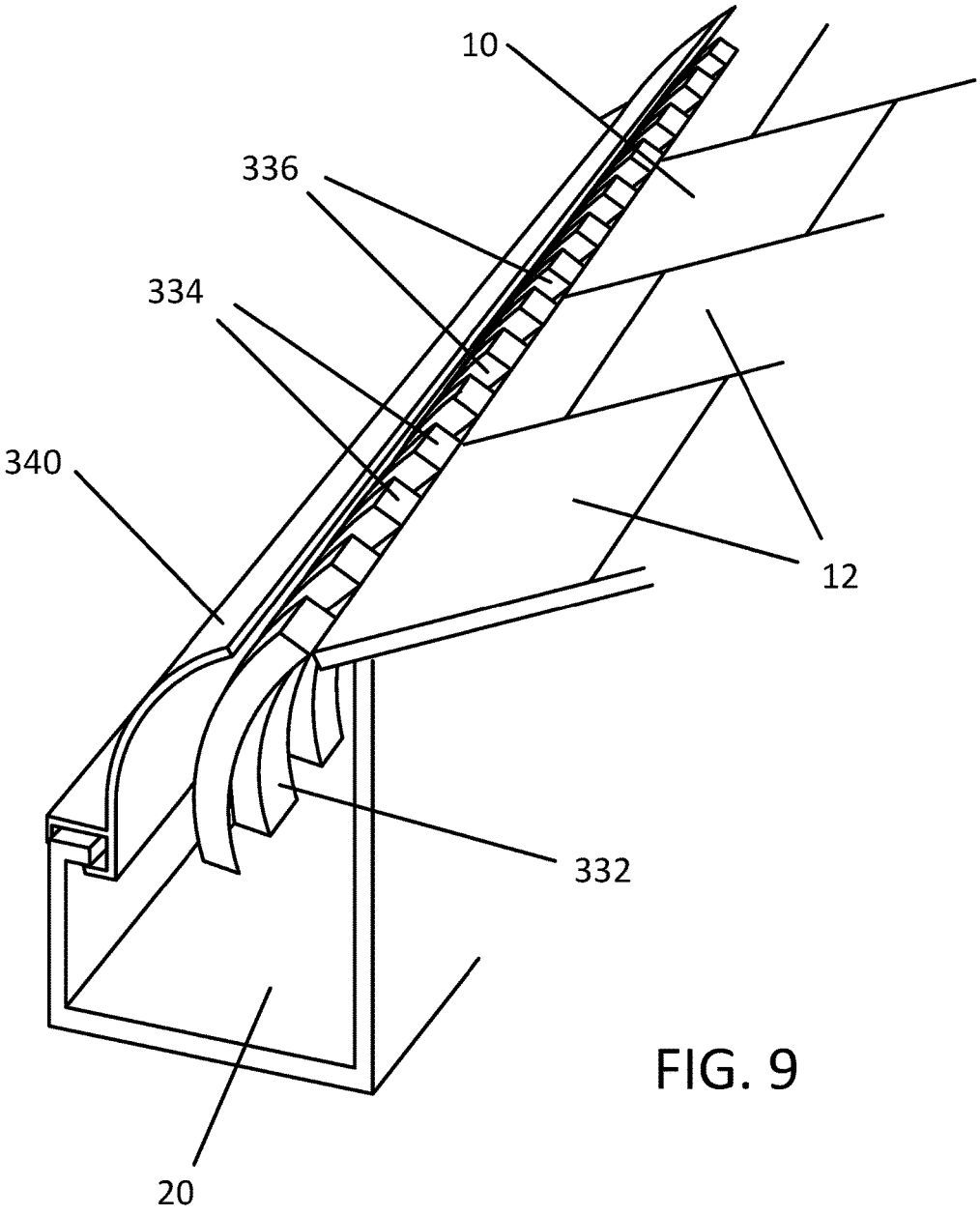
FIG. 9 illustrates in perspective view the gutter protection system of FIG. 5, in accordance with the present disclosure.

FIG. 9 illustrates in perspective view the gutter protection system of FIG. 5. Openings 334 and 336 of corrugated section 332 are situated at a base of roof 10 including shingles 12. As water runs down shingles 12, it comes into contact with openings 334 and 336 and can flow into the openings to be channeled into gutter 20. Debris running down with the water also comes into contact with openings 334 and 336, but is filtered away and can fall past gutter shield panel 340 instead of going with water into gutter 20.

Figure 10:
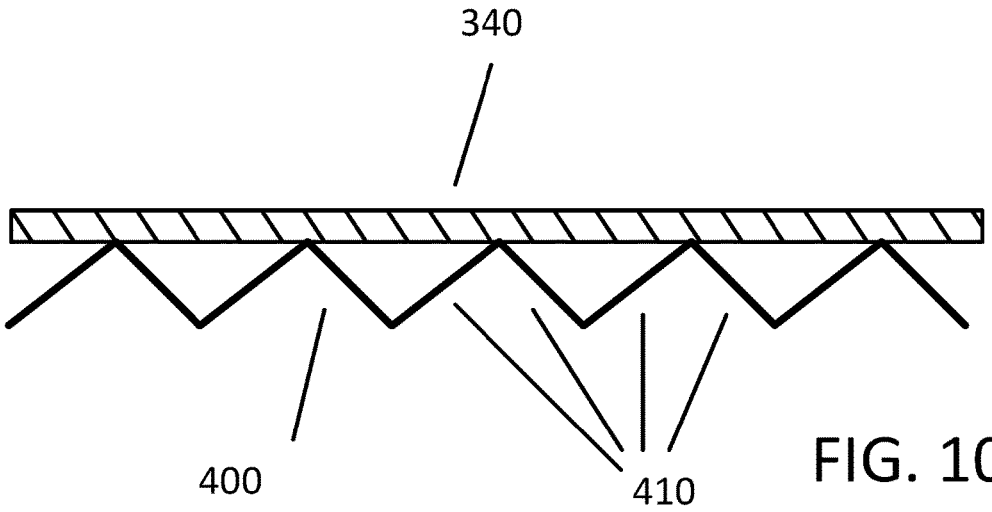
FIG. 10 illustrates in sectional view an exemplary corrugated section with angled walls at an intersection with a gutter shield panel, in accordance with the present disclosure.

FIGS. 6-8 illustrate a corrugated section with a square wall pattern. Other shapes of corrugated sections can be utilized. FIG. 10 illustrates in sectional view an exemplary corrugated section with angled walls at an intersection with a gutter shield panel. Gutter shield panel 340 rests upon corrugated section 400. Walls 410 are angled and alternate in one direction and then another, repeating to form a corrugation pattern. Openings between walls 410 permit water to flow into section 400 while keeping debris out.

The different embodiments of the disclosure include different aperture sizes. Different areas have different types of debris. Areas with deciduous trees have different debris from areas with conifer trees have different debris from areas with a desert or grassland biome. It will be appreciated that water channeling panels with different size apertures can be selected for particular areas.

The disclosure has described certain preferred embodiments and modifications of those embodiments. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A roof gutter cap system, comprising:

a water channeling panel configured to contact an angled roof surface, the panel comprising a plurality of apertures configured to channel water from the roof surface into a gutter attached to the roof; and a gutter shield panel configured to span a distance between the gutter and the water channeling panel and prevent debris from entering the gutter;

wherein the water channeling panel further comprises:

a flat base; and a plurality of bristles attached to and extending upwardly from the flat base;

wherein spaces between the bristles form the plurality of apertures.

2. The roof gutter cap system of claim 1, wherein the gutter shield panel covers ends of the bristles.

3. A roof gutter cap system, comprising:

a water channeling panel configured to contact an angled roof surface, the panel comprising:

a corrugated section including an alternating wall pattern, the alternating wall pattern comprising a square wall pattern; and a plurality of apertures configured to channel water from the roof surface into a gutter attached to the roof; and a gutter shield panel configured to span a distance between the gutter and the water channeling panel and prevent debris from entering the gutter;

wherein spaces between alternating walls of the alternating wall pattern form the plurality of apertures.

4. A roof gutter cap system, comprising:

a water channeling panel configured to contact an angled roof surface, the panel comprising a plurality of apertures configured to channel water from the roof surface into a gutter attached to the roof; and a gutter shield panel configured to span a distance between the gutter and the water channeling panel and prevent debris from entering the gutter;

wherein the water channeling panel further comprises:

a flat base; and a plurality of plastic grass leaves attached to and extending upwardly from the flat base;

wherein spaces between the plastic grass leaves form the plurality of apertures.

5. The roof gutter cap system of claim 4, wherein the gutter shield panel covers ends of the plastic grass leaves.

* * * * *